US011052020B2

(12) United States Patent
Devens

(10) Patent No.: US 11,052,020 B2
(45) Date of Patent: Jul. 6, 2021

(54) PHARMACEUTICAL PACKS COMPRISING HOLOGRAPHIC LIDDING MATERIAL, AND METHOD OF MAKING THE SAME

(71) Applicant: Holographyx Inc., Mahwah, NJ (US)

(72) Inventor: Claude Scott Devens, Suffern, NY (US)

(73) Assignee: Holographyx Inc., Mahwah, NJ (US)

( * ) Notice: Subject to any disclaimer, the term of this patent is extended or adjusted under 35 U.S.C. 154(b) by 168 days.

(21) Appl. No.: 15/792,248

(22) Filed: Oct. 24, 2017

(65) Prior Publication Data

US 2018/0110679 A1 Apr. 26, 2018

Related U.S. Application Data

(60) Provisional application No. 62/413,253, filed on Oct. 26, 2016.

(51) Int. Cl.

| | |
|---|---|
| ***A61J 1/03*** | (2006.01) |
| ***B65B 9/04*** | (2006.01) |
| ***B42D 25/328*** | (2014.01) |
| ***B42D 25/28*** | (2014.01) |

(Continued)

(52) U.S. Cl.

CPC ..... *A61J 1/035* (2013.01); *A61J 1/14* (2013.01); *B42D 25/28* (2014.10); *B42D 25/328* (2014.10); *B65B 9/045* (2013.01); *B65B 61/025* (2013.01); *A61J 2205/50* (2013.01)

(58) Field of Classification Search

CPC ..... A61J 1/035; A61J 1/03; A61J 1/14; A61J 2205/50; B65B 61/025; B65B 9/045; B65B 51/00; B65B 51/14; B65B 7/2878; B65B 9/04–045; B65B 11/52; G03H 2250/39–40

USPC ... 53/478, 329.2, 329.3, 453, 559, 561, 410, 53/411, 131.2, 128.1; 359/1–35; 424/10.2; 156/69, 581

See application file for complete search history.

(56) References Cited

U.S. PATENT DOCUMENTS

| | | | |
|---|---|---|---|
| 3,386,503 | A | 6/1968 | Corning et al. |
| 4,356,052 | A | 10/1982 | Moraw et al. |

(Continued)

FOREIGN PATENT DOCUMENTS

| | | | |
|---|---|---|---|
| IN | 2015DE01903 | A | 6/2015 |
| JP | 2005212811 | A | 8/2005 |
| WO | 2010/023566 | A1 | 3/2010 |

OTHER PUBLICATIONS

Outline of Pharmaceutical Packaging Technology, International Research Journal of Pharmacy, by Patel Rakesh et al. IRJP 1 (1) 2010 105-112 (Year: 2010).*

(Continued)

*Primary Examiner* — Valentin Neacsu

(74) *Attorney, Agent, or Firm* — Duane Morris LLP

(57) ABSTRACT

A pharmaceutical pack and the method for making the same are provided. The pharmaceutical pack includes a blister layer and a lidding sheet disposed over the blister layer. The blister layer defines at least one opening. The lidding sheet includes a first layer and optionally a second layer. The first layer includes at least one hologram, and is disposed on the second layer, which is a plastic film. The blister layer and the lidding sheet define at least one cavity so as to hold at least one pharmaceutical dosage form therein.

10 Claims, 13 Drawing Sheets

(51) Int. Cl.
*B65B 61/02* (2006.01)
*A61J 1/14* (2006.01)

(56) References Cited

U.S. PATENT DOCUMENTS 4,796,408 A * 1/1989 Mobark ..... B65B 31/021 53/427
4,838,965 A * 6/1989 Bussard ..... A41D 27/08 101/129
4,969,965 A * 11/1990 Matty ..... B29C 65/18 156/220
5,115,624 A * 5/1992 Garwood ..... B65B 11/50 426/404
5,464,690 A 11/1995 Boswell
5,578,331 A 11/1996 Martin et al.
5,623,810 A * 4/1997 Dey ..... B65B 9/04 53/281
5,709,067 A * 1/1998 Dey ..... B65B 9/04 198/339.1
5,946,781 A * 9/1999 Kuo ..... B32B 15/08 156/233
6,075,626 A 7/2000 Mizutani et al.
6,155,423 A * 12/2000 Katzner ..... B65D 75/327 206/469
6,414,761 B1 * 7/2002 Stepanek ..... B41M 3/148 359/2
6,458,449 B1 * 10/2002 Parent ..... B41M 5/504 428/304.4
6,548,449 B1 4/2003 Andree et al.
6,852,407 B2 * 2/2005 Yasue ..... B32B 27/32 428/336
7,153,554 B2 12/2006 Spice et al.
7,448,184 B2 * 11/2008 Clark ..... B29C 66/9532 156/69
7,775,017 B2 * 8/2010 Stowell ..... B29C 65/305 53/281
8,399,534 B2 * 3/2013 Arora ..... C09D 11/101 522/64
8,777,013 B1 * 7/2014 Jalindre ..... B65D 75/327 206/534
8,801,043 B2 * 8/2014 Hazen ..... A63F 3/065 101/485
9,354,603 B2 * 5/2016 Motoi ..... G03H 1/0011
9,623,699 B2 4/2017 Ritter et al.
9,709,952 B2 8/2017 Azakami et al.
2003/0118809 A1 * 6/2003 Yasue ..... B32B 27/32 428/323
2004/0105957 A1 * 6/2004 Puttkammer ..... G09F 3/0341 428/137
2005/0103678 A1 * 5/2005 Clark ..... B29C 66/72343 206/538
2006/0065670 A1 3/2006 Doublet et al.
2006/0103130 A1 * 5/2006 Koivukunnas ..... B65D 5/4212 283/81
2006/0230708 A1 * 10/2006 Granili ..... B65B 9/045 53/427
2007/0209322 A1 * 9/2007 Betti ..... B65B 5/103 53/251
2007/0296963 A1 12/2007 Parker et al.
2008/0141623 A1 * 6/2008 Stowell ..... B29C 66/8432 53/287
2008/0308445 A1 * 12/2008 Dolak ..... B65B 11/50 206/471
2009/0272073 A1 * 11/2009 Meyer ..... B29B 13/023 53/141
2010/0287881 A1 * 11/2010 Ehrmann ..... B65B 7/164 53/170
2010/0314036 A1 * 12/2010 Hazen ..... B44C 1/17 156/234
2011/0060069 A1 * 3/2011 Arora ..... C09D 11/101 522/64
2011/0083401 A1 * 4/2011 Scheibel ..... B65B 9/02 53/420
2011/0097548 A1 * 4/2011 Bhandari ..... B32B 15/08 428/164
2011/0101556 A1 5/2011 Bach et al.
2011/0109949 A1 * 5/2011 Hazen ..... A63F 3/065 359/22
2011/0294087 A1 * 12/2011 Gertitschke ..... B29C 51/422 432/253
2013/0118117 A1 * 5/2013 Grobbel ..... B65B 7/00 53/329.2
2014/0054882 A1 * 2/2014 Motoi ..... B42D 25/351 283/85
2014/0331611 A1 * 11/2014 Meyer ..... B29C 65/18 53/445
2015/0183257 A1 * 7/2015 Glendenning ..... B42D 25/425 206/459.5
2015/0209227 A1 * 7/2015 Bamberger ..... A61J 1/035 206/531
2015/0283029 A1 * 10/2015 Riis ..... B65D 65/40 206/438
2016/0001952 A1 1/2016 Kulkarni et al.
2016/0068288 A1 * 3/2016 Palumbo ..... B29C 65/222 53/511

OTHER PUBLICATIONS

International Search Report/Written Opinion dated Jan. 2, 2018, in corresponding International Application No. PCT/US2017/58110.
European Search Report dated Apr. 23, 2020.

* cited by examiner

PHARMACEUTICAL PACKS COMPRISING HOLOGRAPHIC LIDDING MATERIAL, AND METHOD OF MAKING THE SAME

PRIORITY CLAIM AND CROSS-REFERENCE

This application claims the benefit of U.S. Provisional Application No. 62/413,253, filed Oct. 26, 2016, which application is expressly incorporated by reference herein in its entirety.

FIELD OF THE INVENTION

The disclosure relates to pharmaceutical product packaging generally. More particularly, the disclosed subject matter relates to a pharmaceutical pack such as a blister pack comprising anti-counterfeiting features, and the method of making the same.

BACKGROUND

Blister packs are commonly used for the distribution of pharmaceutical products such as pills or capsules because they provide excellent product protection, tamper evidence, childproof safeguards, as well as dosage compliance to show exactly the number of pills that have been taken and those that remain.

One extremely important issue that is currently not being adequately addressed by pharmaceutical blister pack manufacturers is product authentication. A counterfeit drug may contain inappropriate quantities or none of its active ingredients, may be improperly processed within the body, may contain ingredients that are not on the label (which may or may not be harmful), or may be supplied with inaccurate or fake packaging and labeling. The World Health Organization estimates that 10 percent of medicines globally—and as much as one-third in some developing countries—are likely to be counterfeit, and that the annual earnings from substandard and/or counterfeit drugs are over 75 billion U.S. dollars.

Currently, the counterfeiting of pharmaceutical products places the health of millions of patients at risk, who assume that the medications that they are buying are safe and effective.

SUMMARY OF THE INVENTION

The present disclosure provides a pharmaceutical pack such as a blister pack, and a method of making the same.

In some embodiments, such a pharmaceutical pack (e.g., a blister pack) comprises a blister layer and a lidding sheet disposed over the blister layer. The blister layer defines at least one opening. The lidding sheet comprises one or multiple layers, for example, a first layer and optionally a second layer. The first layer comprises at least one hologram, which might be embossed, transferred, or stamped on or in a base material of the first layer. The base material of the first layer may comprise metal, plastics, paper, or a combination thereof. The second layer is a plastic film or a metal foil (e.g. aluminum foil), or a combination thereof. The first layer is disposed on the second layer. The blister layer and the lidding sheet are sealed together and define at least one cavity for holding at least one pharmaceutical dosage form therein.

In some embodiments, the blister layer comprises a plastic material having an optical transparency to visible light in the range of from about 60% to about 100% (e.g., 80-100%, 90-100%). Examples of a suitable material for the blister layer include, but are not limited to, polyvinyl chloride (PVC), polyvinylidene chloride (PVDC), polychlorotrifluoro ethylene (PCTFE), cyclic olefin copolymers (COC), polyethylene (PE), polypropylene (PP), polyethylene terephthalate (PET), and any combination thereof.

The at least one hologram in the lidding sheet may be disposed over the at least one cavity. The hologram may be overt in the pharmaceutical pack in some embodiments. In some embodiments, the hologram will be visible on the top surface of the pharmaceutical pack. The hologram may be designed to provide hidden 2-D or 3-D security features for authentication, and to prevent counterfeiting. In some embodiments, the first layer in the lidding sheet is a metallized holographic paper. The second layer in the lidding sheet may be a plastic (e.g., PET), a metal (e.g., aluminum or tin) foil, or any combination thereof (e.g., aluminum/PET). In some embodiments, for child-resistant blister packs, the second layer made of polyethylene terephthalate (PET) or other plastic film, which may be transparent, is used. In some embodiments, the second layer being an aluminum foil is used when the first layer is a holographic paper.

In some embodiments, the lidding sheet further comprises an adhesive disposed below the first layer, for example, below the second layer or on the bottom surface of the second layer. The blister layer and the lidding sheet are bonded together using the adhesive.

In some embodiments, the pharmaceutical pack further comprises an ink printed on the top surface of the first layer of the lidding sheet and surrounding the at least one hologram. The lidding sheet may further comprise a primer disposed on the top surface of the first layer and between the first layer and the ink. A heat resistant primer is preferred. The primer is used to improve printability of the lidding layer, and also improve adhesion between the ink and the lidding layer. The primer is also utilized to protect the hologram from the high levels of heat that are inherent in the blister-pack sealing process. The ink, which may be in white or a light color, can be used to cover and/or obscure any defects in a portion of hologram or the surrounding area. Possible damage to the holograms outside of the recessed capsule area may be caused by the heat sealing process due to the high sensitivity of embossed holograms to heat. Consumer information such as words, logo, graphics, drug name, manufacturing, expiration dates, dosing instructions, and/or warning information may be printed on the ink.

In some embodiments, the pharmaceutical pack includes multiple (e.g., 2-8) sealed cavities defined by the blister layer and the lidding sheet. One or more (e.g., two) pills or tablets are disposed in each cavity. The pharmaceutical pack may be a blister pack, which may be one of three types: a push-through type, peel-push type, or a lock type. For example, in some embodiments, the pharmaceutical pack is a push-through type of blister pack. A consumer can use a finger to push against the blister layer at or above a cavity to break the lidding layer to push the pharmaceutical dosage out of the cavity. In some other embodiments, the blister layer may be peeled away from the lidding material so that a consumer can retrieve the pharmaceutical dosage that is sealed in a cavity.

In another aspect, the present disclosure provides a method for making a pharmaceutical pack such as a blister pack as described. In some embodiments, such a method comprises the following steps. A lidding sheet comprising a first layer and optionally a second layer is provided. The first layer comprises at least one hologram and is disposed on the second layer. The second layer is a plastic (e.g., PET) film, a metal (e.g., Al) foil, or a combination thereof (e.g., laminated PET/Al). The method further comprises providing a blister layer defining at least one opening, placing the lidding sheet over the blister layer, and applying a plate (e.g., a heating plate) defining a recess therein onto the lidding sheet. At least one pharmaceutical dosage form is introduced into the at least one opening defined by the blister layer. The recess in the plate is disposed above the at least one hologram. The plate may not be in direct contact with the at least one hologram in some embodiments, or at least not in direct contact with the main body of the at least one hologram, which is designed to remain in a final product. The plate may be made of metal, ceramic, or other suitable material, and may function as a molding plate. The plate may be used as a sealing tool or a portion of a sealing tool, and is configured to prevent or minimize any damage to the at least one hologram, because of the sensitivity of holograms to heat.

The method further comprises sealing the lidding sheet and the blister layer together so as to form a pharmaceutical pack. The blister layer and the lidding sheet define at least one cavity for holding at least one pharmaceutical dosage form therein.

In some embodiments, the step of providing the lidding sheet comprises any of the following steps: bonding the first layer and the second layer together, applying an adhesive below the first layer, for example, below the second layer or onto the bottom surface of the second layer, and applying a primer onto a top surface of the first layer. In some embodiments, the adhesive is a heat activated adhesive, and the lidding sheet and the blister layer are sealed together using heating and pressure. In some other embodiments, the adhesive may be a pressure sensitive adhesive, and the lidding sheet and the blister layer are sealed together using pressure without heat.

In some embodiments, the method further comprises printing an ink on the top surface of the first layer of the lidding sheet. The ink is printed in such a manner that the hologram above the cavity is left uncovered by the ink and remains clearly visible to the consumer. The hologram above the cavity is not be negatively impacted by the heat due to the recess in the heating plate that has been designed to be directly above the cavity for pills or tablets. The remainder of the holographic material, which is negatively impacted by its direct contact with the heating plate is covered by ink to obscure the holographic distortion created by heat. This allows this area to be overprinted with a white, or light colored layer of ink, which can then be printed with marketing or dosage information. In some embodiments, the ink is applied to the areas surrounding the at least one hologram, which is visible in a final product.

In some embodiments, the at least one hologram in the lidding sheet is placed over the at least one opening (or cavity) defined by the blister layer. The hologram is intended to be visible on the top surface of the pharmaceutical pack in some embodiments.

In some embodiments, the present disclosure provides a method for forming a blister pack. Such a method comprises providing a lidding sheet comprising a first layer and optionally a second layer. The first layer comprises at least one hologram and is disposed on the second layer. The second layer is a plastic film, or a metal foil, or any combination thereof. For example, the second layer may include two layers: a PET layer and an aluminum layer. In some embodiments, providing the lidding sheet comprises the following steps: bonding the first layer and the second layer (including possibly multiple layers for the second layer), applying an adhesive onto a bottom surface of the second layer, and applying a heat resistant primer onto a top surface of the first layer.

The method further comprises placing the lidding sheet over a blister layer. The blister layer defines at least one opening. The at least one hologram is disposed over the at least one opening. The method further comprises applying a plate defining a recess therein above and/or onto the lidding sheet. The plate is for heat and pressure sealing. The recess is disposed above the at least one hologram. The method further comprises sealing the lidding sheet and the blister layer together utilizing heat and pressure. The blister layer and the lidding sheet define at least one cavity for holding at least one pharmaceutical dosage form therein. The method may further comprise printing a white ink on the top surface of the first layer of the lidding sheet so that the white ink surrounds the at least one hologram, after the lidding sheet and the blister layer are sealed together. Information such as a drug's name, manufacturing and expiration dates, dosing instructions, and warning information may be then printed on the white ink.

BRIEF DESCRIPTION OF THE DRAWINGS

The present disclosure is best understood from the following detailed description when read in conjunction with the accompanying drawings. It is emphasized that, according to common practice, the various features of the drawings are not necessarily to scale. On the contrary, the dimensions of the various features are arbitrarily expanded or reduced for clarity. Like reference numerals denote like features throughout the specification and drawings.

DETAILED DESCRIPTION

Figure 1A:
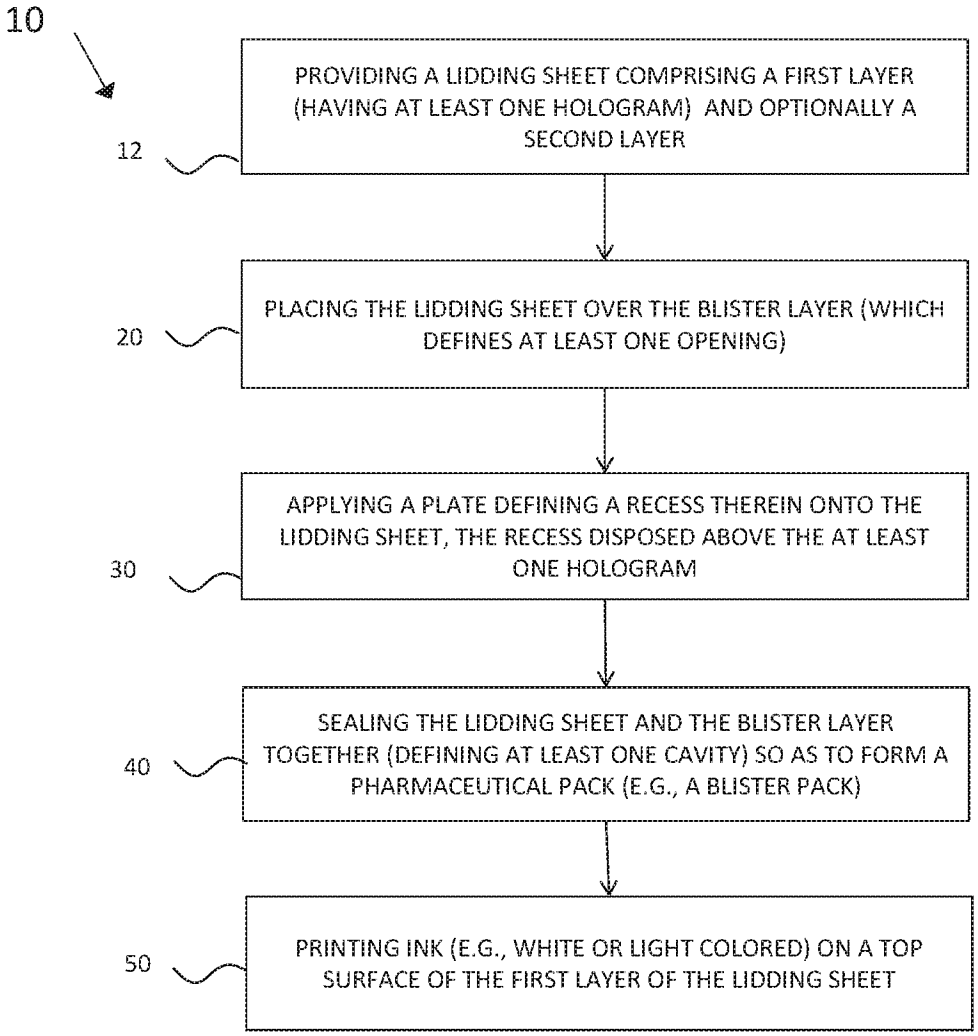
FIG. 1A is a flow chart illustrating an exemplary method for forming a pharmaceutical pack in accordance with some embodiments.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

For purposes of the description hereinafter, it is to be understood that the embodiments described below may assume alternative variations and embodiments. It is also to be understood that the specific articles, compositions, and/or processes described herein are exemplary and should not be considered as limiting.

In the present disclosure the singular forms "a," "an," and "the" include the plural reference, and reference to a particular numerical value includes at least that particular value, unless the context clearly indicates otherwise. Thus, for example, a reference to "a hologram" or "a holographic structure" is a reference to one or more of such structures and equivalents thereof known to those skilled in the art, and so forth. When values are expressed as approximations, by use of the antecedent "about," it will be understood that the particular value forms another embodiment. As used herein, "about X" (where X is a numerical value) preferably refers to ±10% of the recited value, inclusive. For example, the phrase "about 8" preferably refers to a value of 7.2 to 8.8, inclusive; as another example, the phrase "about 8%" preferably (but not always) refers to a value of 7.2% to 8.8%, inclusive. Where present, all ranges are inclusive and combinable. For example, when a range of "1 to 5" is recited, the recited range should be construed as including ranges "1 to 4", "1 to 3", "1-2", "1-2 & 4-5", "1-3 & 5", "2-5", and the like. In addition, when a list of alternatives is positively provided, such listing can be interpreted to mean that any of the alternatives may be excluded, e.g., by a negative limitation in the claims. For example, when a range of "1 to 5" is recited, the recited range may be construed as including situations whereby any of 1, 2, 3, 4, or 5 are negatively excluded; thus, a recitation of "1 to 5" may be construed as "1 and 3-5, but not 2", or simply "wherein 2 is not included." It is intended that any component, element, attribute, or step that is positively recited herein may be explicitly excluded in the claims, whether such components, elements, attributes, or steps are listed as alternatives or whether they are recited in isolation.

The present disclosure provides a pharmaceutical pack (or package) such as a blister pack, and a method of making the same. The pharmaceutical pack comprises at least one hologram to provide authentication and prevent counterfeiting. A holographic lidding material layer is used in some embodiments.

Figure 5A:
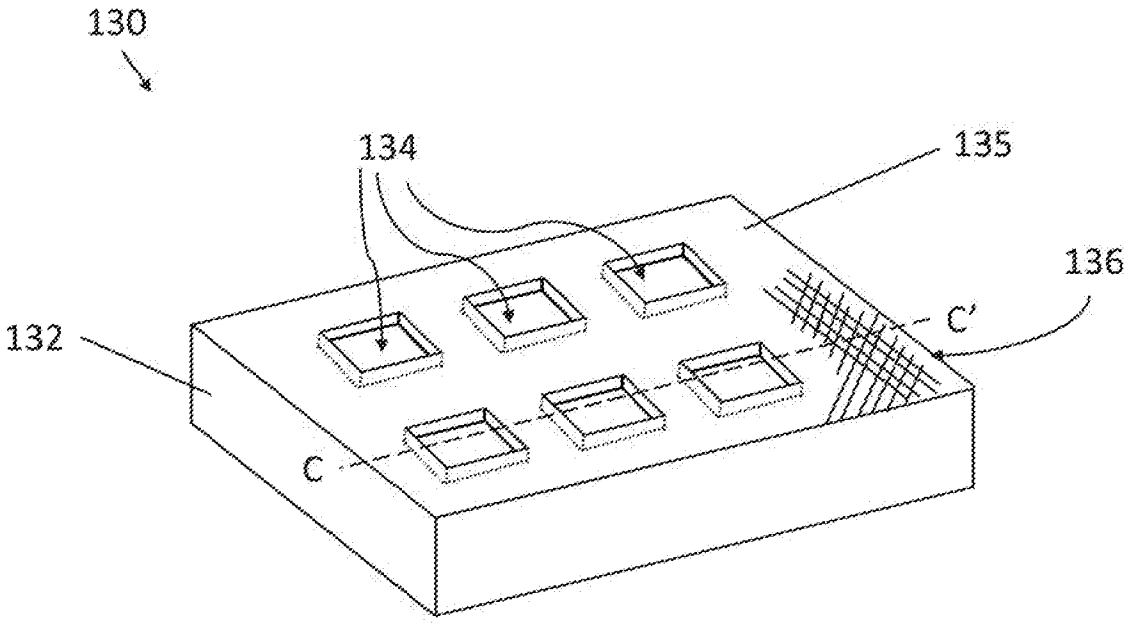
FIG. 5A is a perspective view of an exemplary plate (or sealing tool) defining at least one recess in accordance with some embodiments.
Figure 5B:
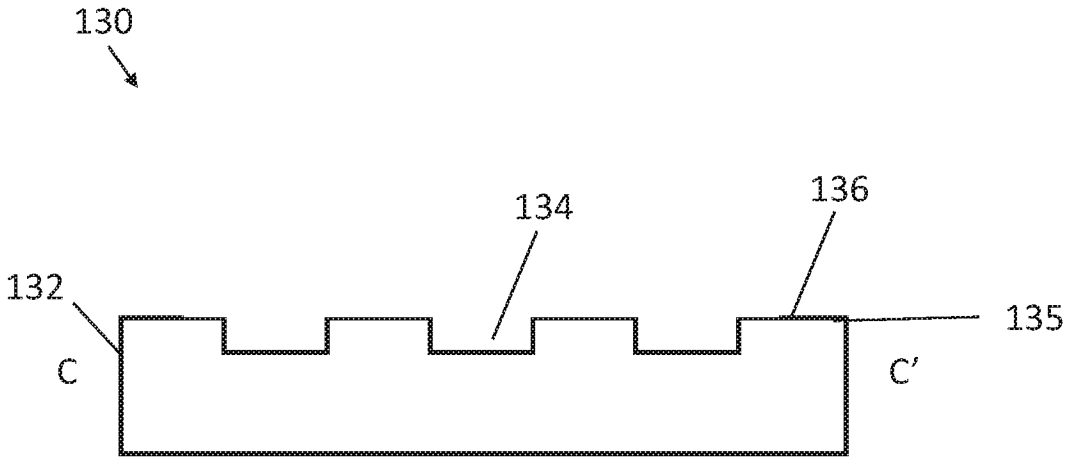
FIG. 5B is a cross-sectional view of the exemplary plate (or sealing tool) of FIG. 5A (along line C-C').
Figure 6:
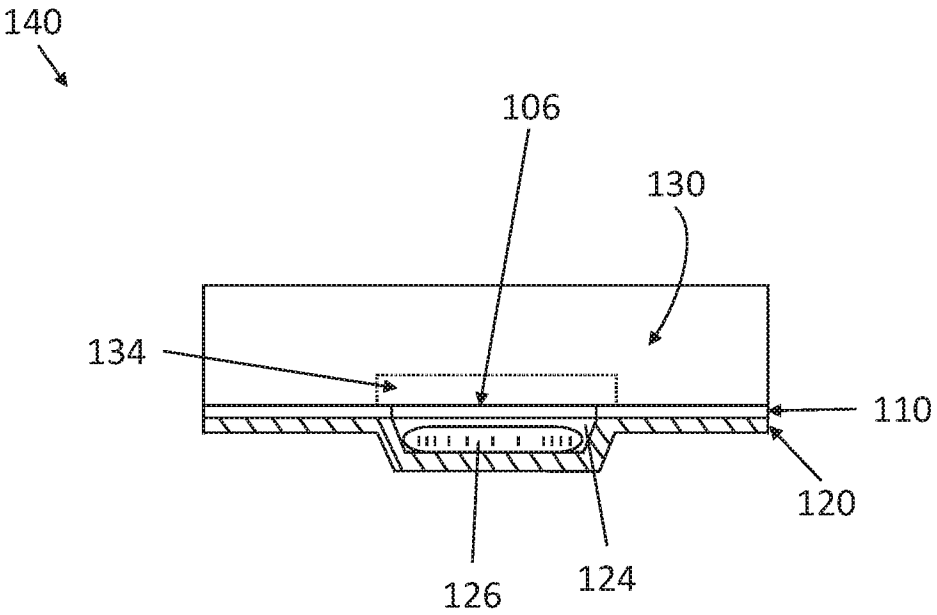
FIG. 6 is a cross-sectional view of a portion of an exemplary assembly during fabrication comprising a blister layer, a lidding sheet, and a plate in accordance with some embodiments.
Figure 7:
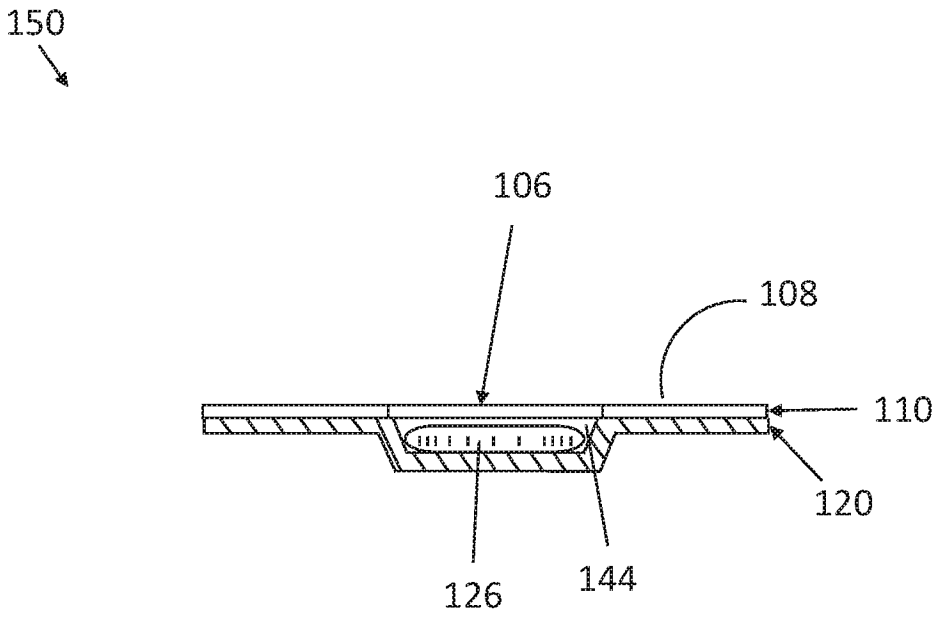
FIG. 7 is a cross-sectional view of an exemplary pharmaceutical pack in accordance with some embodiments.
Figure 8A:
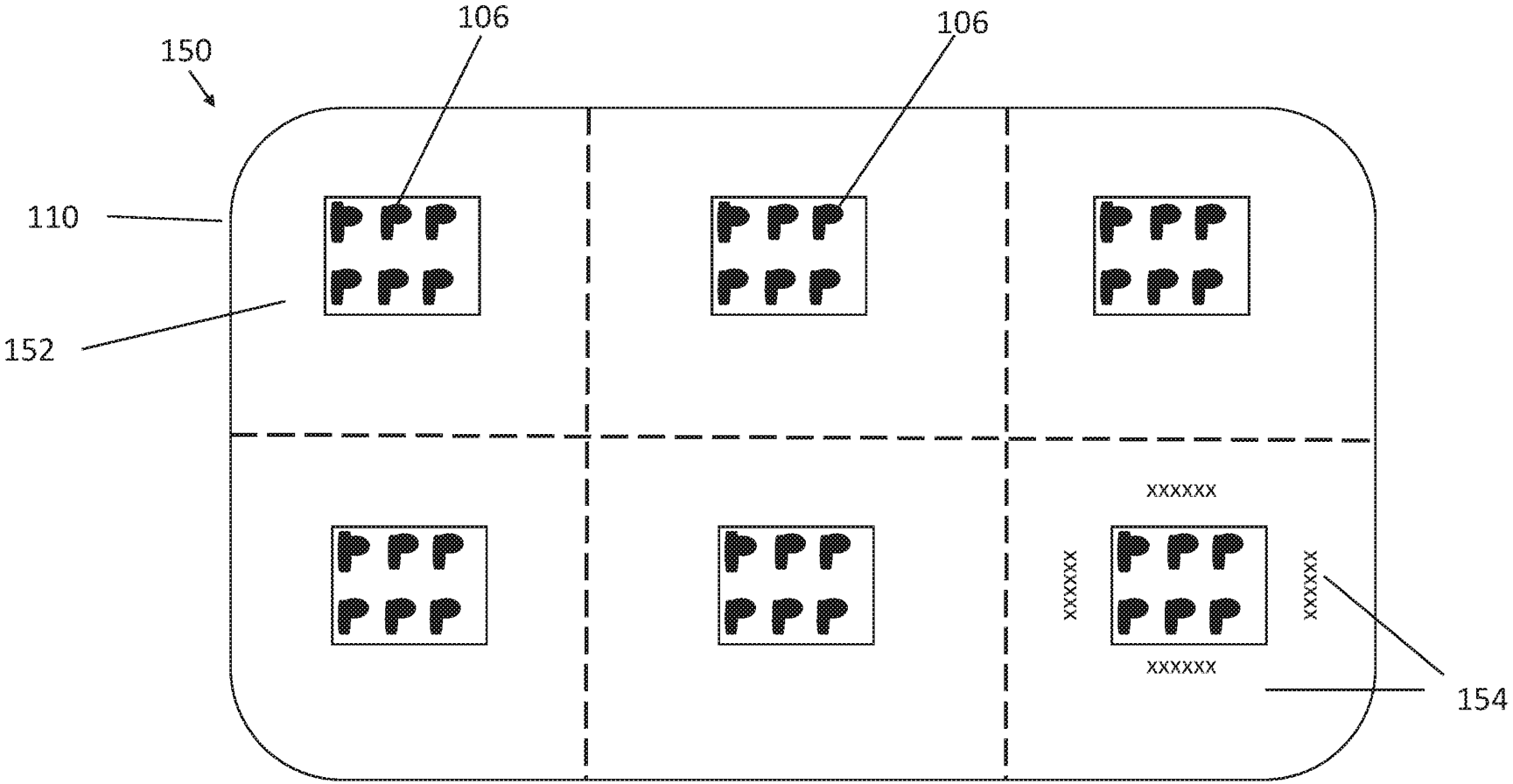
FIG. 8A is a plan view illustrating an exemplary front side (the lidding sheet side) of an exemplary pharmaceutical pack in accordance with some embodiments.
Figure 8B:
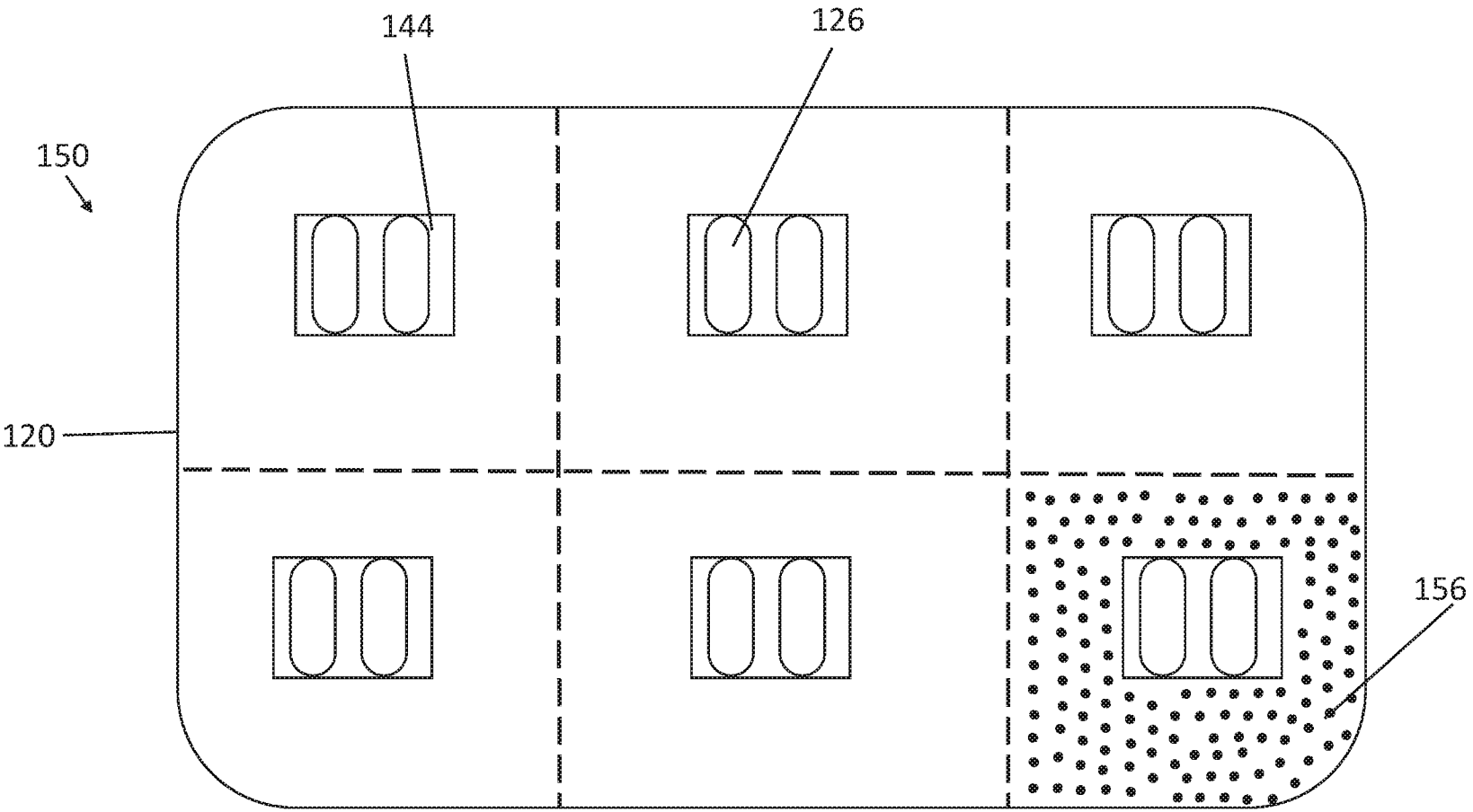
FIG. 8B is a plan view illustrating an exemplary back side (the blister layer side) of the exemplary pharmaceutical pack of FIG. 8A.

In FIGS. 1A-8B, like items are indicated by like reference numerals, and for brevity, descriptions of the structure, provided above with reference to the preceding figures, are not repeated. The methods described in FIGS. 1A-1B are described with reference to the exemplary structure described in FIGS. 2A-6. The resulting product structures are illustrated in FIGS. 7 and 8A-8B.

Unless expressly indicated otherwise, references to "hologram" or "holographic feature" made below will be understood to encompass a photograph of an interference pattern that, when illuminated, produces a two-dimensional or three-dimensional image.

References to "a blister layer" or "a blister film" made below will be understood to encompass a layer used as a bottom part of a pharmaceutical pack such as a blister pack, with one or more recesses or openings formed therein. Such recesses or opening are formed through vacuum forming or pressure forming. A product piece such as a pharmaceutical dosage form (e.g., a tablet or pill) is positioned and held therein.

References to "a lidding sheet," "lidding foil," or "a lidding material layer" made below will be understood to encompass a cover of a pharmaceutical pack such as a blister pack, and such a cover is placed over and sealed to the blister layer. The one or more recesses or openings in a blister layer are sealed by a lidding sheet to form one or more corresponding cavities. At least one pharmaceutical dosage form (e.g., a tablet or pill) is disposed and held therein in a pharmaceutical pack. For brevity, an adhesive and a primer disposed thereon are also described as portions of a lidding sheet in the present disclosure. The adhesive and the primer can be described as separate layers or materials.

A lidding material layer is the structural component upon which a blister package is built. Such a lidding material layer may be made of metal such as aluminum, paper, or plastic or any layered combination thereof. The lidding material layer is adhered to a blister layer (e.g., a plastic layer) with the use of heat and/or pressure, through a heat or pressure sensitive adhesive coating.

To identify counterfeit packaging, the authenticity of a blister pack comprising pharmaceutical products can be visually confirmed with the use of custom overprinted holographic lidding material that is embossed, transferred or stamped into layered sheets of paper, plastic, and/or aluminum. Lidding material can be holographically embossed using images such as a pharmaceutical company's logo combined with a wide range of proprietary 2D or 3D images specifically designed to deter counterfeiting. The holographic images can then be selectively overprinted with graphics along with the product's applicable dosing/usage information.

To maximize the security and performance of the holographic lidding material layer additional overt and covert elements can be integrated into the holograms. The use of security devices such as hidden (latent) images, which can only be detected with special lighting (such as laser or UV), or the integration of micro text into the holographic image, can make the fraudulent duplication the holographic substrate extremely difficult to implement. In addition to use within the pharmaceutical industry, other valuable consumer goods marketed in blister packs that may be subject to fraudulent duplication (i.e. branded disc shaped batteries) can also benefit from the use of holographic lidding material for product authentication.

The method and the product provided in the present disclosure are suitable for mass production of blister pack packaging having holograms, which was previously considered to be cost prohibitive. Wide-web holographic manufacturing has reduced the cost of producing large quantities of holograms so that they can now be cost-effectively used with disposable packaging applications. In accordance with some embodiments, a holographic material layer can be used as a lidding sheet or as a layer for the lidding sheet. Holograms that are more complex can be cost-effectively included to provide pharmaceutical packs with heightened security features. In addition to its functional improvements, the resulting product projects a high quality aesthetic appearance.

Figure 1B:
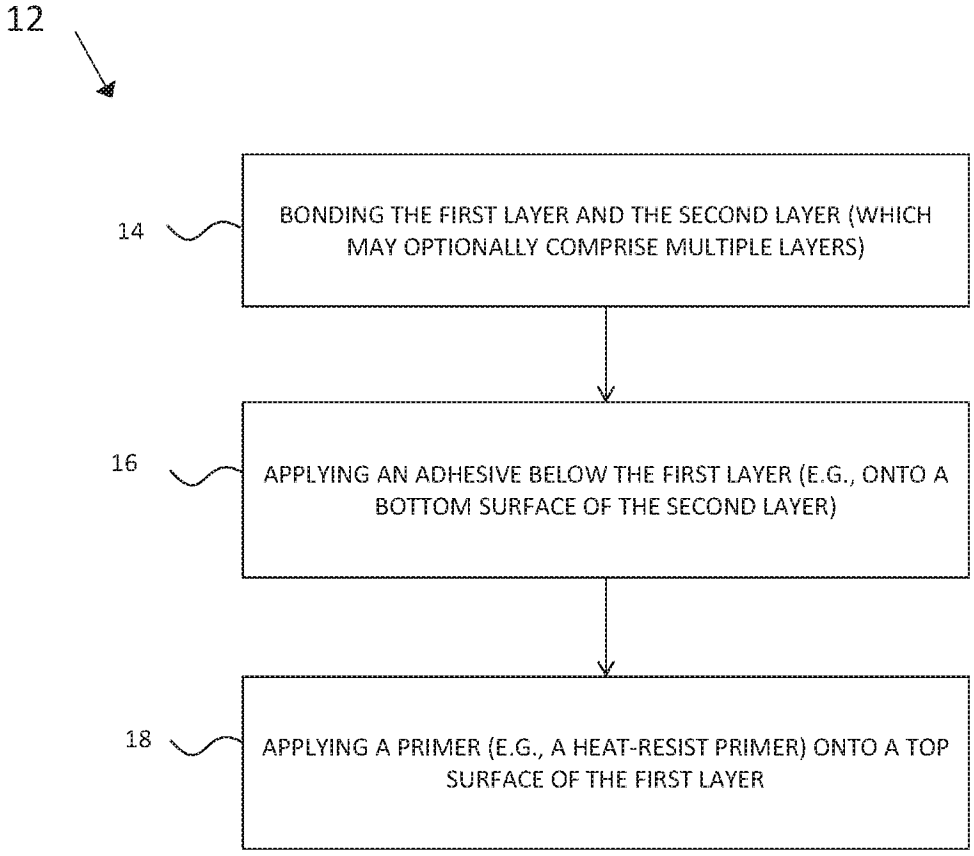
FIG. 1B is a flow chart illustrating an exemplary method for providing a lidding sheet in accordance with some embodiments.

Referring to FIGS. 1A-1B, an exemplary method 10 for making a pharmaceutical pack such as a blister pack is provided. In some embodiments, such a method comprises one or more of steps 12, 20, 30, 40 and 50.

Figure 2A:
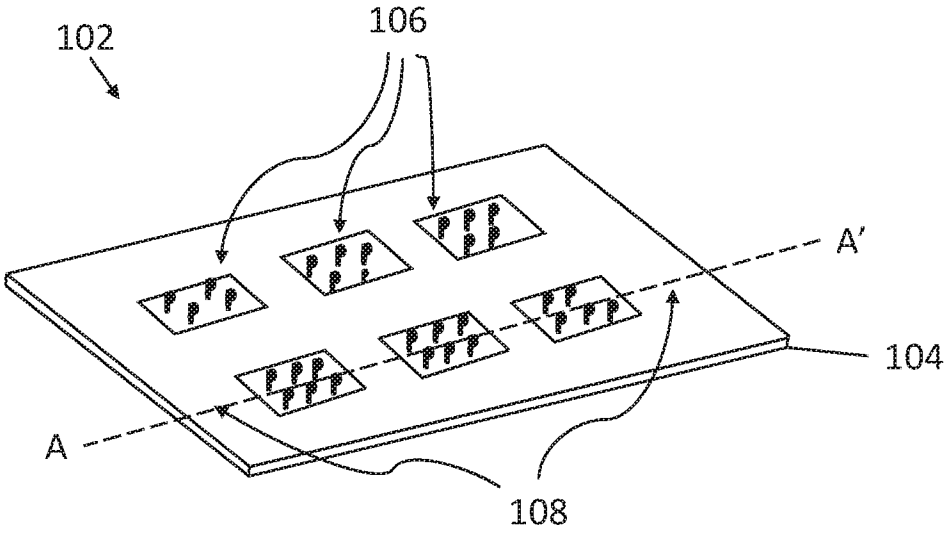
FIG. 2A is a perspective view of an exemplary first layer of a lidding sheet comprising at least one hologram in accordance with some embodiments.
Figure 2B:
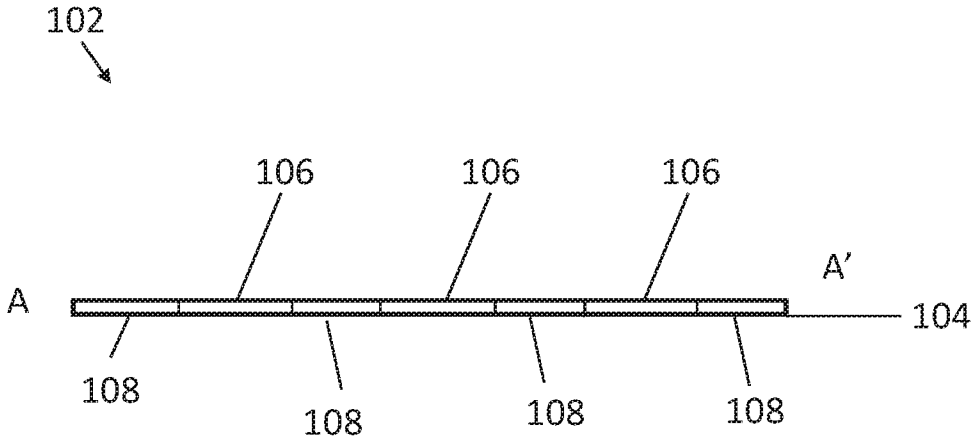
FIG. 2B is a cross-sectional view of the exemplary first layer of FIG. 2A (along line A-A').
Figure 3A:
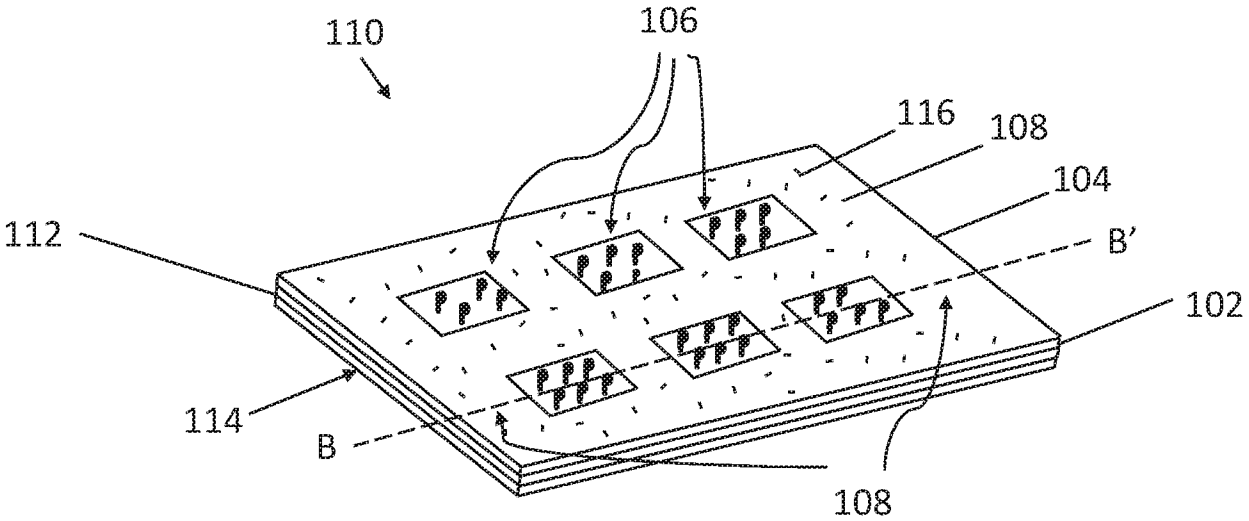
FIG. 3A is a perspective view of an exemplary lidding sheet comprising at least one hologram in accordance with some embodiments.
Figure 3B:
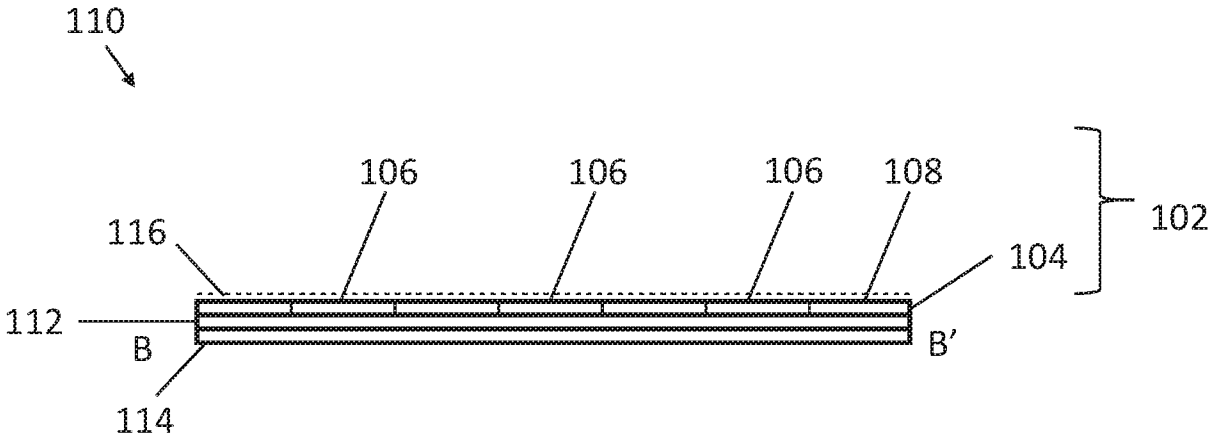
FIG. 3B is a cross-sectional view of the exemplary lidding sheet of FIG. 3A (along line B-B').

At step 12, a lidding sheet 110 incorporating at least one hologram is provided. In some embodiments, the lidding sheet 110 comprises a first layer 102 and a second layer 112. The second layer 112 may be optional in some embodiments. An exemplary first layer 102 is illustrated in FIGS. 2A-2B. An exemplary lidding sheet 110 is illustrated in FIGS. 3A-3B. Referring to FIGS. 2A-2B, the first layer 102 comprises at least one hologram 106. The first layer 102 is disposed on the second layer 112. The second layer 112 may be optional in some embodiments.

The at least one hologram 106 may be transferred onto, embossed directly onto, or hot or cold stamped onto the first layer 102, which includes a base material 104. The base material 104 may be paper, plastic, aluminum, or a combination thereof. The at least one hologram 106 is transferred, embossed, stamped onto or into the base material 104. In another aspect, the first layer 102 includes a base material 104 and the at least one hologram 106.

In some embodiments, the first layer 102 in the lidding sheet 110 is a metallized holographic paper. For example, a transfer holographic aluminum foil is used in some embodiments. The holographic security effect has been transferred on the aluminum surface from a PET film (or carrier material). In some other embodiments, a directly embossed holographic foil or paper is used. For example, a holographic aluminum foil (HOLO-A), which is directly embossed, is available under a trademark ALUCARE®, from Daivy s. r. l. of Italy. The holographic images are micro-embossed on the foil before the packing process. The holographic images may be in a thickness from 7 microns to 60 microns. The directly embossed holographic aluminum foil may be used for "push-through" pharmaceutical blister packs. When the directly embossed holographic aluminum foil is used as the first layer 102, the second layer 112 may be optional for "push-through" blister packaging applications.

In some embodiments, the first layer 102 is a holographic paper. The holographic paper can be available from a company such as the Hazen Paper Company of Massachusetts, U.S.A. The holographic paper may have a weight in the range of from about 10 $g/m^2$ to about 50 $g/m^2$, for example from about 15 $g/m^2$ to about 30 $g/m^2$.

Referring to FIGS. 2A-2B, in some embodiments, the at least one hologram 106 may be patterned on the first layer 102. The holograms 106 may be also distributed throughout the first layer 102 including peripheral areas 108 (FIG. 2A). The excessive holograms in such peripheral areas 108 or any other area are to be covered by inks in a step of printing (i.e. overprinting) as described below.

The second layer 112 in the lidding sheet 110 may be a plastic (e.g., PET), a metal (e.g., aluminum or tin) foil, or any combination thereof (e.g., aluminum/PET). In some embodiments, the second layer 112 made of polyethylene terephthalate (PET) or other plastic film, which may be transparent, is used. Such a combination may be used for child resistant blister packs. In some embodiments, the second layer 112 being an aluminum foil is used when the first layer 102 is a holographic paper. For child resistant packs, an additional layer of PET can be used in combination with an aluminum foil as the second layer 112 when a holographic paper is used as the first layer 102.

The selection and combination of the first layer 102 and the second layer 112 can provide different structures. For illustration only, the following exemplary structures can be obtained. In some embodiments, the first layer 102 includes a base material 104 made of metal (e.g., aluminum) and the at least one hologram 106. The first layer 102 without a second layer 112 is used in the lidding sheet 110 for push-though packs.

In some embodiments, the first layer 102 includes a base material 104 made of metal (e.g., aluminum) and the at least one hologram 106. The first layer 102, and a second layer 112 such as a PET film are used in the lidding sheet 110 for child-resistant packs.

In some embodiments, the first layer 102 includes a base material 104 made of paper and the at least one hologram 106. A second layer 112 being an aluminum foil is used in the lidding sheet 110 for improved moisture resistance.

In some embodiments, the first layer 102 is a holographic paper as described. A second layer 112 including a PET film and an aluminum foil is used in the lidding sheet 110 for child-resistant packs having improved moisture resistance. The PET film can be disposed between the first layer 102 and the aluminum foil.

Referring to FIG. 1B, in some embodiments, an exemplary step 12 of providing the lidding sheet 110 may comprise any or all of steps 14, 16 and 18. The resulting structure of the lidding sheet 110 is illustrated in FIGS. 3A-3B.

At step 14, the first layer 102 and the second layer 112 are bonded together. In some embodiments, the first layer 102 and the second layer 112 are laminated together through a suitable process such as thermoforming.

At step 16, an adhesive 114 is applied below the first layer 102, for example, below the second layer 112 or onto a bottom surface of the second layer 112. The adhesive 114 may be a heat activated adhesive, or a pressure sensitive adhesive. In some embodiments, the adhesive 114 may be cured using visible light or ultra-violet light. The adhesive 114 may be an oligomer or a polymer made of acrylic, acrylate, epoxy, urethane, silicone, or any combination thereof.

At step 18, a primer 116 is applied onto a top surface of the first layer 102. The primer 116 functions as an adhesion promoter for an ink to be subsequently printed thereon. Chemically, the primer 116 may comprise acrylic, epoxy, or silane coupling agents. The structure of FIGS. 3A-3B is for illustration only. In some embodiments, as a thin layer, the primer 116 is uniformly distributed on the entire top surface of the first layer 102. In some embodiments, the primer 116 may be applied to the peripheral areas 108 only. The primer 116 is optically clear and resistant to heat in some embodiments.

Figure 4:
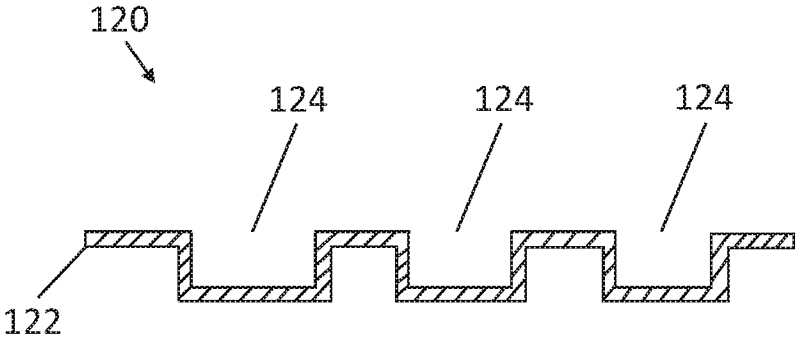
FIG. 4 is a cross-sectional view of an exemplary blister layer defining at least one opening in accordance with some embodiments.

At step 20 of FIG. 1A, the lidding sheet 110 is placed over a blister layer 120. Before step 20, the blister layer 120 is provided. Referring to FIG. 4, an exemplary blister layer 120 is illustrated. Such an exemplary blister layer 120 includes a base film 122 having at least one recess, and defines at least one opening 124 therein. The exemplary blister layer 120 may be formed by depressing the base film 122 in a mold under pressure or under vacuum.

In some embodiments, the blister layer 120 comprises a plastic material having an optical transparency to visible light in the range of from about 60% to about 100% (e.g., 80-100%, 90-100%). The blister layer 120 may be transparent or translucent, and may have moisture barrier properties. In some embodiments, the blister layer 120 may be opaque. Examples of a suitable material for the blister layer 120 include, but are not limited to, polyvinyl chloride (PVC), polyvinylidene chloride (PVDC), polychlorotrifluoro ethylene (PCTFE), cyclic olefin copolymers (COC), polyethylene (PE), polypropylene (PP), polyethylene terephthalate (PET), and any combination thereof.

In some embodiments, the at least one hologram 106 is disposed over the at least one opening 124. In some embodiments, at least one pharmaceutical dosage form 126 (FIG. 6) is introduced into the at least one opening 124 defined by the blister layer 120.

In some embodiments, the first layer 102 and the second layer 112 may be supplied or made in wide web sizes, resulting from web (roll) manufacturing processes. Before step 20 or 30, they may be sliced into smaller rolls (e.g., about 140 mm in width), which will fit into blister packing machines.

At step 30, applying a plate 130 defining a recess 134 therein onto the lidding sheet 110. An exemplary plate 130 (or called the upper sealing tool) is illustrated in FIGS. 5A-5B. The resulting structure 140 at step 30 is illustrated in FIG. 6.

Referring to FIGS. 5A-5B, an exemplary plate 130 may be made of a metal or ceramic, and defines at least one recess 134 therein on one surface 135. The surface 135 may be referred as a bottom surface of the plate 130. The plate 130 in FIGS. 5A-5B is placed upside down. The at least one recess 134 may have a suitable depth, for example, in a range from about 1 mm to 5 mm, and may have a shape matching with the opening 124 on the second layer 112. At step 30, the surface 135 is in contact with the first layer 102 of the lidding sheet 110. The side and location of the at least one recess 134 correspond to the size and location of the at least one hologram 106 in the first layer 102. For example, the size of one respective recess 134 on the plate 130 is substantially equal to or slightly larger than that of the size of a respective hologram 106.

As illustrated in FIG. 5A, the exposed surface 136 of the plate 130, which is the surface 135 except the at least one opening 134, corresponds to the peripheral areas 108 of the first layer 102 of the lidding sheet 110. The exposed surface 136 includes a fine knurl pattern, with a plurality of small projecting ridges, which will imprint such a pattern onto the lidding sheet 110 and the blister layer 120 when the two layers are sealed together. The use of the fine knurl pattern also allows for even heat distribution and minimizes the likelihood that the print primer on the holographic lidding material may adhere to the upper sealing tool. The knurl pattern shown in FIG. 5A is for illustration only. The whole exposed surface 136 may have such a knurl pattern, which is uniformly distributed thereon. The plate 130 may be made of metal, ceramic, or other suitable material, and may function as a molding plate.

Referring to FIG. 6, in some embodiments, the at least one recess 134 is disposed above the at least one hologram 106 in the lidding sheet 110. The surface 136 of the plate 130 may not be in direct contact with the at least one hologram 106 in some embodiments, or at least not in direct contact with the main body of the at least one hologram 106, which is shown in a final product. The hologram 106 may be sensitive to heat, mechanical stress, or other processing conditions. The plate 130 may be used as a sealing tool or a portion of a sealing tool, and is configured to prevent or minimize any damage to the at least one hologram 106. Such a configuration in the plate 130 also minimizes damage to the pharmaceutical dosage 126 disposed in the recess 124 of the blister layer 120.

At step 40 of FIG. 1A, the lidding sheet 110 and the blister layer 120 are bonded and sealed together so as to form an exemplary pharmaceutical pack 150. The resulting structure is illustrated in FIG. 7. The exemplary pharmaceutical pack 150 is also illustrated in FIGS. 8A-8B. For the illustration only, FIG. 7 shows only one unit of pharmaceutical pack, and FIGS. 8A-8B illustrates six units of pharmaceutical pack. For brevity, some features are illustrated or marked in only one unit, while the other units comprise the same features. An exemplary pharmaceutical pack 150 may comprise any number of units. The dotted line illustrates that each unit may be cut or torn from other units in one same pack.

The blister layer 120 and the lidding sheet 110 define at least one corresponding cavity 144 (or pocket) for holding at least one pharmaceutical dosage form 126 therein. In some embodiments, the adhesive 114 is a heat activated adhesive, and the lidding sheet 110 and the blister layer 120 are sealed together using heat and pressure by the plate 130. Step 40 may be performed at an increased temperature, for example, in a range of from 150° C. to 250° C. (e.g., from 180° C. to 250° C.). The pressure may be in a range from about 1 $Kg/cm^2$ to about 10 Kg/cm' (e.g., about 2.8 Kg/cm' to about 5.6 $Kg/cm^2$). The dwell time may be in a range from about 0.01 second to about 1 second (e.g., from about 0.05 second to 0.25 second). In some other embodiments, the adhesive 114 is a pressure sensitive adhesive, and the lidding sheet 110 and the blister layer 120 are sealed together under pressure. The pressure and the dwell time may be the same as those described above.

As illustrated in FIGS. 6-7, in some embodiments, the at least one hologram 106 in the lidding sheet 110 is placed over the at least one opening 124 defined by the blister layer 120. The hologram 106 will be visible on the top surface of the pharmaceutical pack.

At step 50 of FIG. 1A, a continuous layer of opaque masking ink 152 (FIG. 8A) is printed on a top surface of the first layer 102 of the lidding sheet 110 and surrounding the at least one hologram 106. Step 50 may be optional in some embodiments. This step is also referred as overprinting. The ink 152 may be printed in the peripheral areas 108. In some embodiments, the ink 152 is white or in a light color. Step 50 may be performed after the lidding sheet 110 and the blister layer 120 are sealed together. Information 154 such as the drug's name, manufacturing date, expiration date, dosing instructions, and warning information may be then printed on the ink 152. The ink 152 may also be used to cover possible distortions to the hologram 106.

In some embodiments, the present disclosure provides solutions to at least two problems. One aspect being addressed relates to the degradation of holography by heat applied to the heating plates that are used to activate the adhesive layer of the lidding material thereby allowing it to adhere to the plastic "blister" material. In some embodiments, the heating plates are flat (without recess), and provide even distribution of heat across the entire surface of the lidding material. To prevent the heat from the plates from degrading the holography in specific areas, the plate used to apply the holographic lidding material is configured to have areas that are recessed in the positions that lie above where the pharmaceutical pills are inserted. This area does not require a heat seal (because it is directly above the pills). By recessing the heating plates in these areas, it will minimize the direct impact of the heat upon these areas, thus resulting in the elimination of the heat degradation of the holography in the locations above the pill cavities.

Another aspect being addressed is the impact of the blister-pack heat seal process with holograms 106. To date, the heat used in the sealing process has prevented holography and a holography film from being used for the blister packaging application. Because embossed holograms are heat sensitive (heat tends to distort and degrade the holographic effect), the specific areas of the hologram that would be impacted by the heat sealing process will be overprinted with ink (e.g., an opaque white or light colored ink). The ink 152 can cover any holographic distortion, while allowing overprinting of the hologram with graphics and information such as dosage instructions. This overprinting is accomplished following the application of a primer 116 that is applied on top of the holographic material.

The combination of reduced heat in specified locations (e.g., above the cavity 144), and the use of an overprinted masking layer in areas where the heat is directly applied, allows the holography to remain visible without being degraded in the desired areas, for example, directly above the pill cavities. Such a combination also allows overprinting throughout the remainder of the lidding material so as to totally cover and obscure any distortion of the holographic images that would have been caused by the application of heat. The net result is unobscured and highly visible holographic images in the areas delineated by the cavity 144 surrounded by overprinted holography across the remaining surface area of the lidding material. The white masking overprinted area not only obscures the heat damaged/distorted holography, but also allows the surface to be utilized to print usage or dosage information that is typically used on the back of lidding material.

Referring to FIG. 7, and FIGS. 8A-8B, the exemplary pharmaceutical pack 150 comprises a lidding sheet 110 and a blister layer 120. The lidding sheet 110 is disposed over the blister layer 120. The blister layer 120 defines at least one opening 124. The lidding sheet 110 comprises a first layer 102 and optionally a second layer 112. The first layer 102 comprises at least one hologram 106. In some embodiments, the second layer 112 is a plastic film, a metal foil, or any combination thereof as described above. The first layer 102 is disposed on the second layer 112. The blister layer 120 and the lidding sheet 110 are sealed together and define at least one cavity 144 for holding at least one pharmaceutical dosage 126 form therein.

The at least one hologram 106 in the lidding sheet 110 may be disposed over the at least one cavity 144. The hologram 106 is visible on the top surface of the pharmaceutical pack 150. In some embodiments, the hologram 106 may be made visible inside the at least one cavity 144 though the blister layer 120. The hologram 106 may be designed to provide hidden 2-D or 3-D security features, and prevent from counterfeiting.

In some embodiments, the lidding sheet 110 further comprises an adhesive 114 disposed below the first layer 102, for example, on a bottom surface of the second layer 112. The blister layer 120 and the lidding sheet 110 are bonded together through the adhesive 114.

In some embodiments, the exemplary pharmaceutical pack 150 further comprises an ink 152 printed on a top surface of the first layer 102 of the lidding sheet 110 and surrounding the at least one hologram 106. The lidding sheet 110 may further comprise a primer 116 disposed on the top surface of the first layer 102 and between the first layer 102 and the ink 152. The primer 116 is used to improve printability of the lidding layer 110, improve adhesion between the ink 152 and the lidding layer 110, and provide an additional protection to the holographic image from the heat inherent in the sealing process. The opaque ink 152, which may be in white or a light color, can be used to cover any defects in a portion of hologram or the surrounding area. Information such as drug name, manufacturing and expiration dates, dosing instructions, and warning information may be printed on the surface of this masking layer of the ink 152. Referring to FIG. 8B, in the exemplary pharmaceutical pack 150 (or package), the laminated portion of the lidding sheet 110 and the blister layer 120 include a pattern 156, which results from a fine knurl pattern 136 on the plate 130. Such a pattern 156 may be more apparent on the bottom surface of the lidding sheet 110 in some embodiments.

In some embodiments, the exemplary pharmaceutical pack 150 includes multiple (e.g., 2-8) sealed cavities 144 defined by the blister layer 120 and the lidding sheet 110. One or more (e.g., two) pills or tablets 126 are disposed in each cavity 144. The exemplary pharmaceutical pack 150 provided in the present disclosure may be one of three different types of blister packs, depending on how a consumer or patient is meant to retrieve the pharmaceutical dosage form: push-through type, peel-push type and lock type. For example, in some embodiments, the pharmaceutical pack 150 is a push-through type of blister pack. A consumer can use his or her finger to push against the deformable blister layer 120 at the location of a cavity 144 to break the lidding layer 110 so as to push the pharmaceutical dosage 126 form out of the cavity 144. In some other embodiments, a consumer first peels away the blister layer 120 (or at least the first layer 102) from the lidding material 110 so that a consumer can retrieve the pharmaceutical dosage 126 form sealed in a cavity 144. If the first layer 102 is peeled away, the consumer may need to then push against the blister layer 120 at the location of a cavity 144 to break through the second layer 112 of the lidding sheet 110 and then retrieve a pharmaceutical dosage form. In the "lock" type of blister pack, a consumer can only access to the pharmaceutical dosage 126 form by cutting the lidding sheet 110 using a tool such as a pair of scissors, a knife, or with his or her nails.

Currently, the counterfeiting of pharmaceutical products places the health of millions of patients at risk who assume that the medications that they are buying are safe and effective. As a result of the innovations detailed in this patent application, the integration of holographic lidding material or film onto blister packages can now be used to provide an additional layer of security that will ensure that the pharmaceutical products that they contain are authentic.

Although the subject matter has been described in terms of exemplary embodiments, it is not limited thereto. Rather, the appended claims should be construed broadly, to include other variants and embodiments, which may be made by those skilled in the art.

What is claimed is:

1. A method comprising steps of:

providing a lidding sheet comprising a first layer, the first layer comprising at least one hologram;

providing a blister layer, the blister layer defining at least one opening;

placing the lidding sheet over the blister layer;

applying a plate defining a recess therein onto and contacts the lidding sheet, the recess disposed above the at least one hologram, wherein the recess provides a gap between the plate and the at least one hologram above the at least one opening of the blister layer when the plate contacts the lidding sheet; and sealing the lidding sheet and the blister layer together so as to form a pharmaceutical pack, wherein the blister layer and the lidding sheet define at least one cavity for holding at least one pharmaceutical dosage form therein, wherein the gap provided by the recess is maintained unchanged during the step of sealing, wherein a layer of opaque masking ink is printed on a top surface of the first layer of the lidding sheet and surrounding the at least one hologram, whereby the hologram above the cavity is left uncovered by the opaque masking ink.

2. The method of claim 1, wherein the providing the lidding sheet comprises bonding the first layer and a second layer, the first layer is disposed on the second layer, the second layer is a plastic film or a metal foil.

3. The method of claim 1, wherein the providing the lidding sheet comprises applying an adhesive below the first layer.

4. The method of claim 3, wherein the adhesive is a heat activated adhesive, and the lidding sheet and the blister layer are sealed together using heating and pressure.

5. The method of claim 3, wherein the adhesive is a pressure sensitive adhesive, and the lidding sheet and the blister layer are sealed together under pressure.

6. The method of claim 1, wherein the at least one hologram in the lidding sheet is placed over the at least one opening defined by the blister layer.

7. The method of claim 1, further comprising introducing at least one pharmaceutical dosage form into the at least one opening defined by the blister layer.

8. The method of claim 1, wherein the first layer in the lidding sheet is a metallized holographic paper.

9. A method for forming a blister pack, comprising steps of:

providing a lidding sheet comprising a first layer, the first layer comprising at least one hologram;

placing the lidding sheet over a blister layer, the blister layer defining at least one opening, the at least one hologram disposed over the at least one opening;

applying a plate defining a recess therein onto and contacts the lidding sheet, the recess disposed above the at least one hologram, wherein the recess provides a gap between the plate and the at least one hologram above the at least one opening of the blister layer when the plate contacts the lidding sheet; and sealing the lidding sheet and the blister layer together under heating, wherein the blister layer and the lidding sheet define at least one cavity for holding at least one pharmaceutical dosage form therein, wherein the gap provided by the recess is maintained unchanged during the step of sealing, wherein the providing the lidding sheet comprises:

bonding the first layer and a second layer, the first layer disposed on the second layer, the second layer being a plastic film or a metal foil; and applying an adhesive onto a bottom surface of the second layer;

said method further comprising printing a layer of opaque masking ink on a top surface of the first layer of the lidding sheet and surrounding the at least one hologram, whereby the hologram above the cavity is left uncovered by the opaque masking ink.

10. The method of claim 9, wherein the first layer in the lidding sheet is a metallized holographic paper.

* * * * *